US005649667A

United States Patent [19]

Folsberg

[11] Patent Number: 5,649,667

[45] Date of Patent: Jul. 22, 1997

[54] RING ROLLER MILL

[75] Inventor: Jan Folsberg, Valby, Denmark

[73] Assignee: F.L. Smidth & Co. A/S, Denmark

[21] Appl. No.: 569,109

[22] PCT Filed: Jun. 22, 1994

[86] PCT No.: PCT/DK94/00255

§ 371 Date: Dec. 18, 1995

§ 102(e) Date: Dec. 18, 1995

[87] PCT Pub. No.: WO95/00246

PCT Pub. Date: Jan. 5, 1995

[30] Foreign Application Priority Data

Jun. 23, 1993 [DK] Denmark ..... 0748/93

[51] Int. Cl.[6] ..... B02C 17/10

[52] U.S. Cl. ..... 241/47; 241/122

[58] Field of Search ..... 241/47, 54, 122

[56] References Cited

U.S. PATENT DOCUMENTS 1,220,155 3/1917 Fraser ..... 241/122 X
1,693,247 11/1928 Molz .
1,831,625 11/1931 Hardinge .
1,938,045 12/1933 Schmidt ..... 241/47
3,537,658 11/1970 JurgenJanich ..... 241/54 X
3,614,002 10/1971 Dore .

FOREIGN PATENT DOCUMENTS 501036 6/1930 Germany ..... 241/122
667001 11/1938 Germany .

*Primary Examiner*—John M. Husar
*Attorney, Agent, or Firm*—Brumbaugh, Graves, Donohue & Raymond

[57] ABSTRACT

A ring roller mill for grinding mineral clinker materials and the like comprises at least one grinding ring, at least one roller and at least one air outlet opening within the outer circumference of the grinding ring and air inlet openings on each side of the air outlet opening in the rotating direction of the grinding ring. The location of the air inlet and outlet openings, and respectively, relative to each other ensure that substantially lower flow rates occur in the mill at a certain volume flow rate compared to hitherto known mills. At the same time a more stable operation of the mill is ensured.

4 Claims, 2 Drawing Sheets

RING ROLLER MILL

BACKGROUND OF THE INVENTION

The invention relates to a ring roller mill for grinding mineral clinker materials or the like and comprising at least one grinding ring and at least one roller as well as air inlet and air outlet openings for the passage of air.

Such mills may for example be used in connection with the production of cement where cement, slags or the like receive final grinding.

Compared to other roller grinding apparatuses, a ring roller mill is characterized in that the recycling of material may be effected inside the mill as it is also seen in e.g. a tube mill. However, it is a disadvantage of a tube mill that it is significantly more space-consuming than a ring roller mill of identical capacity.

Ring roller mills with and without air passage are commonly known, and the separation of finely ground material may for instance be effected by conveying a portion of the ground material to a sieve where material having a certain defined maximum grain size is separated off whereas the remaining material is recycled. Thus, material is recycled which comprises so small grains that, in such mills, operation problems in the form of vibrations often occur during fine-grinding.

In case of ring roller mills of the type disclosed above which are known from i.a. DE patent No. 667,011 and from U.S. Pat. No. 1,693,247, the air is caused to pass through the milling chamber along one single route, usually axially in the mill, which means that operation takes place at high air flow rates with ensuing losses of pressure in the volume flow rate of air which is necessary for the conveyance of the ground material out of the mills. Consequently the establishment of such air flow requires much power. Moreover, the large flow velocity means that particles having substantially larger grain sizes than desired are discharged from the mill. Therefore, such particles Bust be separated off and reconveyed to the mill. The known mills are associated with the additional disadvantage that a unilateral passage of air effects an accumulation of material at the one side of the mill thereby causing lop-sided operation with ensuing increased loads on roller, grinding ring, bearings, etc. Said disadvantages associated with the known ring roller mill, viz. a large power consumption and the necessary comprehensive reconveyance of material from a separation process to the mill, mean that, despite the disadvantages associated therewith, it has been preferred to use the tube mill rather than ring roller mills.

SUMMARY OF THE INVENTION

Therefore, it is the object of the invention to provide a ring roller mill of the type disclosed above which requires substantially less power, provides improved material distrubution in the mill, and wherein reconveyance of separated material is reduced.

This object is achieved with a ring roller mill which is characterized in that it comprises at least one air outlet opening provided within the outer circumference of the ring and at least one air inlet opening at each side of said air outlet opening in the rotating direction of the ring.

As the inlet openings are located at each their side of the outlet opening and the air passages between the inlet and the outlet openings do not have common flow routes until they meet at the outlet, the flow rate at each side of the outlet opening may be reduced substantially compared to the flow rate in a Bill where the entire flow of air is caused to follow one single flow route, and consequently the pressure loss across the mill may be reduced significantly. The reduced flow rate moreover means that the power exerted on the particles in the milling chamber is reduced thereby preventing larger particles than intended from being carried along with the air flow and thus eliminating the need for comprehensive reconveyance of material to the mill.

According to a preferred embodiment the ring roller mill according to the invention may be provided with an outlet opening on each side of the grinding ring and with inlet openings located at each side of the outlet openings and at both sides of the grinding ring. This has the additional effect that the air flow becomes symmetrical about a plane perpendicular to the rotating axis of the ring and the said accumulation of materiale at the one side of the mill is avoided.

In both cases a mill of compact construction is obtained which mill requires a low energy consumption as well a limited reconveyance of material thereby making the ring roller mill according to the invention particularly desirable compared to other mill types, such as the tube mill.

BRIEF DESCRIPTION OF THE DRAWINGS

One embodiment of the invention will be explained in the following with reference to the drawings, wherein.

BRIEF DESCRIPTION OF THE PREFERRED EMBODIMENTS

Figure 1:
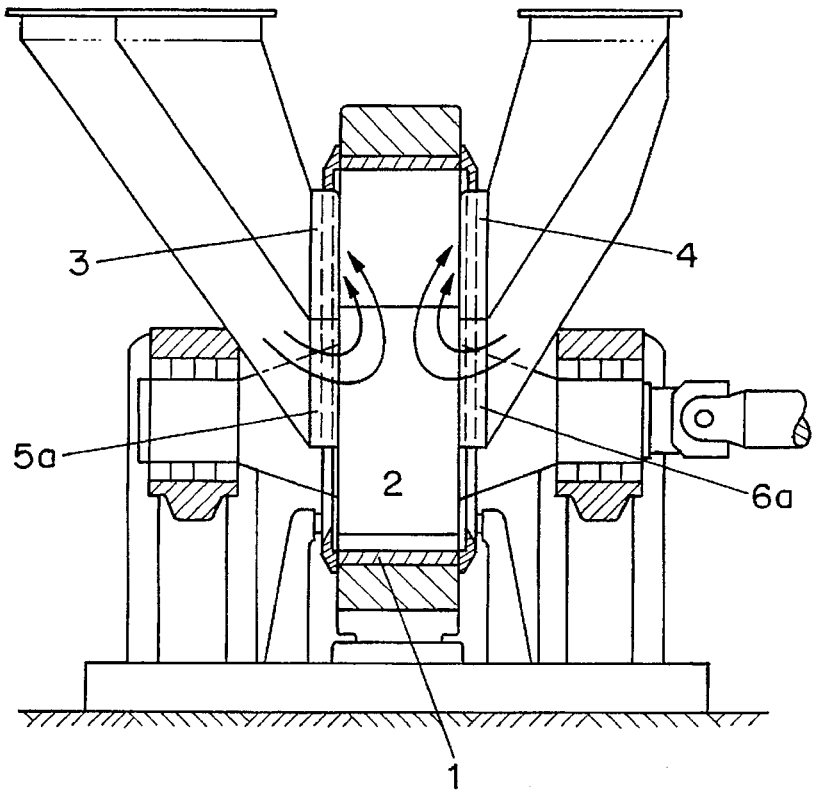
FIG. 1 is an axially sectional and schematical view of a ring roller mill.

In the embodiment shown the mill is provided with a grinding ring 1 and a roller 2. By means of a shaft the roller is connected to a motor (not shown). The ring is also rotated by means of a driving mechanism (not shown). The grinding ring and the roller are encased so that undesirable escape of ground matter from the grinding chamber does not occur. The ring roller mill is provided with air inlet openings 5*a*, 5*b*, 6*a*, 6*b* and air outlet openings 3, 4 in the casing and on each side of the ring. The locations of the openings, except for the opening 6*b*, will appear from FIGS. 1 and 2. The not shown air inlet opening 6*b* is located opposite the opening 5*b*.

Figure 2:
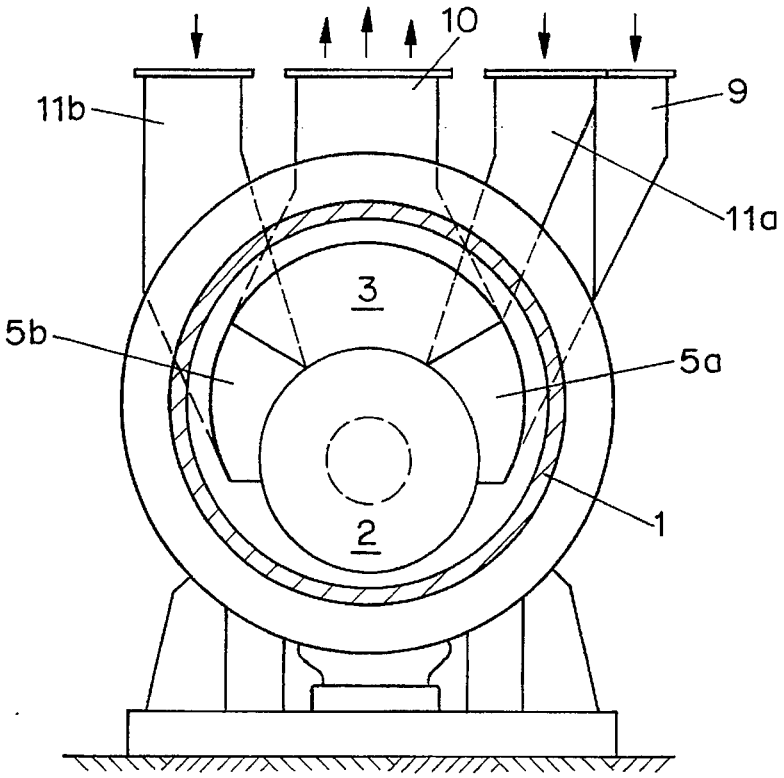
FIG. 2 is a diametrally sectional and schematical view of a ring roller mill.
Figure 3:
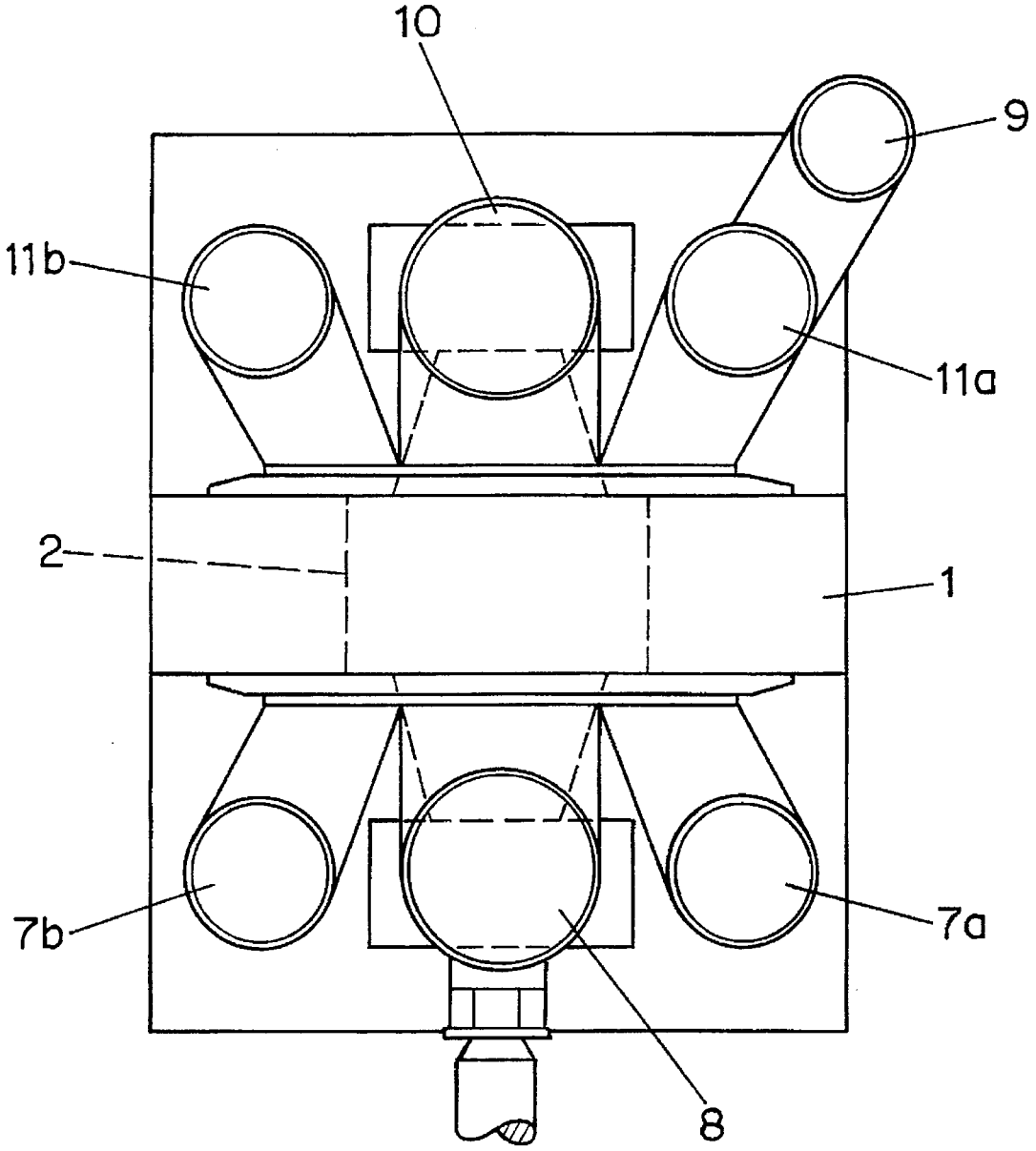
FIG. 3 is a view of a ring roller mill seen from above.

It will appear from FIG. 2 that the air inlet openings are located at each their side of the outlet opening in the rotating direction of the ring.

In communication with the air inlet openings 5*a*, 5*b*, 6*a*, 6*b* ducts 11*a*, 11*b*; 7*a*, 7*b* are arranged. The air outlet openings 3, 4 are correspondingly provided with ducts 8, 10.

In communication with an air inlet opening a duct 9 is arranged for the introduction of new material and for recycled material.

The conveyance of finished material away from the mill is effected by a volume flow of air therethrough which is adjusted in accordance with the grinding capacity of the mill.

During operation the air flows between the inlet openings 5*a*, 5*b*, 6*a*, 6*b* and the outlet openings 3, 4 will thus be separate until they meet at the outlet openings. Hereby it is obtained that the volume flow is divided so as to follow separate flow routes. The flow rate is reduced with a value which corresponds to the distribution of the volume flow, preferably in a 1:1 ratio on each side of the outlet openings. The pressure loss in a duct flow will depend on the square of the flow rate, and a 50 per cent reduction of the flow rate thus reduces the pressure loss to one fourth.

Symmetrically located inlet and outlet openings provides even distribution of the material in the mill and the lopsided operation of the roller and the grinding ring with ensuing mechanical loads and wear is avoided.

Moreover, the use of two outlet openings makes it possible to couple separators with different characteristics to each pipeline 8, 10 thereby permitting a more flattened distribution of the cement grain size.

I claim:

1. A ring roller mill comprising at least one grinding ring and at least one roller as well as air inlet and outlet openings, characterized in that the mill comprises at least one air outlet opening provided within the outer circumference of the grinding ring and at least one air inlet opening provided on each side of the air outlet opening in the rotating direction of the grinding ring.

2. A ring roller mill according to claim 1, characterized in that air outlet openings are provided on each side of the grinding ring, and that air inlet openings are provided on each side of the two air outlet openings.

3. A ring roller mill according to claim 2, characterized in that the individual air outlet opening is provided in an area above the roller where the distance between the grinding ring and the roller is the largest, and that the air inlet openings are arranged symmetrically relative to each outlet opening.

4. A ring roller mill according to claim 1, characterized in that the individual air outlet opening is provided in an area above the roller where the distance between the grinding ring and the roller is the largest, and that the air inlet openings are arranged symmetrically relative to each outlet opening.

* * * * *